United States Patent [19]

Fujimoto

[11] Patent Number: 4,542,723

[45] Date of Patent: Sep. 24, 1985

[54] STARTING FUEL INCREASING SYSTEM FOR INTERNAL COMBUSTION ENGINES

[75] Inventor: Hiroaki Fujimoto, Hamamatsu, Japan

[73] Assignee: Sanshin Kogyo Kabushiki Kaisha, Hamamatsu, Japan

[21] Appl. No.: 507,508

[22] Filed: Jun. 24, 1983

[30] Foreign Application Priority Data

Jul. 30, 1982 [JP] Japan ..... 57-132071

[51] Int. Cl.[4] ..... F02M 1/16

[52] U.S. Cl. ..... 123/187.5 R; 123/179 G; 123/180 P

[58] Field of Search ..... 123/187.5 R, 179 G, 123/180 R, 180 P

[56] References Cited

U.S. PATENT DOCUMENTS

| | | | |
|---|---|---|---|
| 4,373,479 | 2/1983 | Billingsley et al. | 123/187.5 R |
| 4,375,206 | 3/1983 | Baltz et al. | 123/187.5 R |
| 4,380,974 | 4/1983 | Grosso | 123/179 G |

FOREIGN PATENT DOCUMENTS

| | | | |
|---|---|---|---|
| 57-198349 | 12/1982 | Japan | 123/179 G |
| 112422 | 3/1918 | United Kingdom | 123/187.5 R |

*Primary Examiner*—Andrew M. Dolinar

*Attorney, Agent, or Firm*—Ernest A. Beutler

[57] ABSTRACT

A simplified and improved cold enrichment device for an internal combustion engine. The device includes a valve that controls communication of a fuel source with a cold starting enrichment port and which valve is operatively connected to a pump for pumping additional fuel to the engine upon movement of the valve from a normal condition to a cold enrichment position.

15 Claims, 1 Drawing Figure

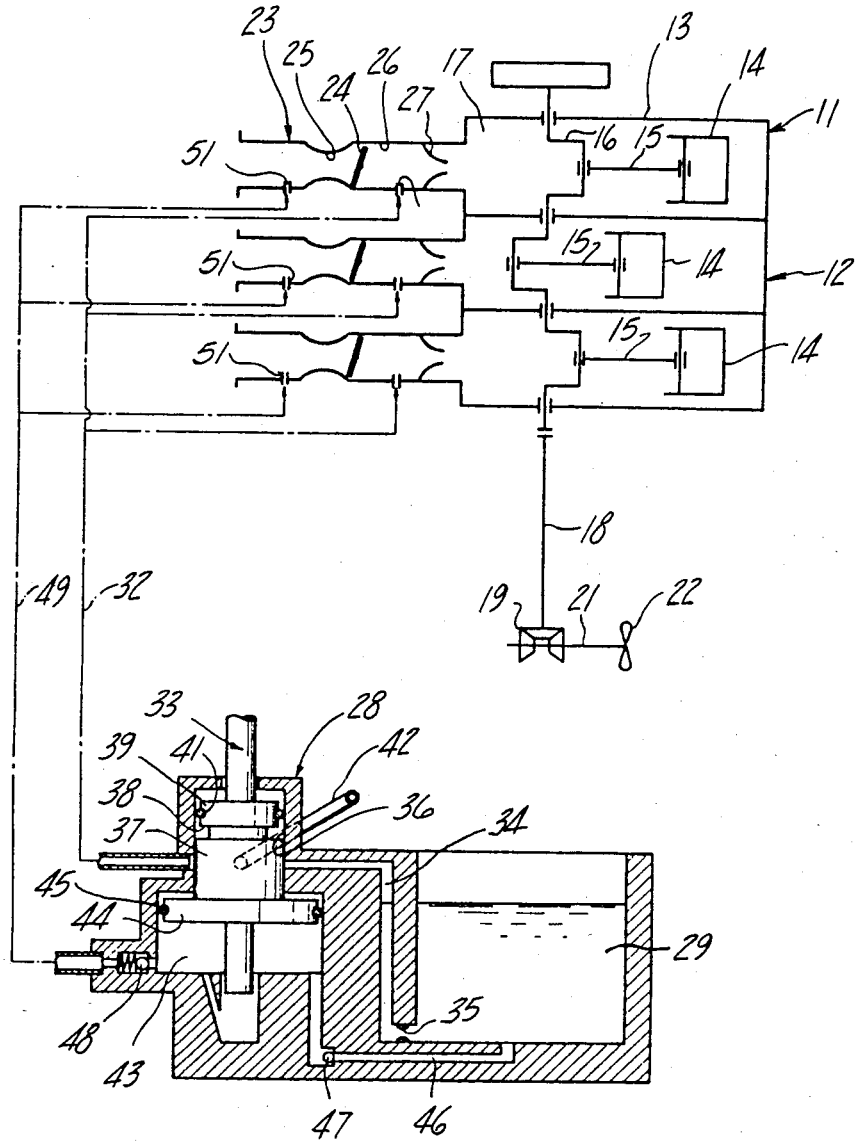
23
25
24
26
27
17
13
14
11
16
15
51
15
14
12
51
15
14
51
18
49
32
19
21
22
33
28
39
41
42
38
36
37
34
45
44
29
35
48
43
47
46

STARTING FUEL INCREASING SYSTEM FOR INTERNAL COMBUSTION ENGINES

BACKGROUND OF THE INVENTION

This invention relates to a starting fuel increasing system for internal combustion engines and more particularly to an improved cold starting mechanism for such engines.

As is well known, it is desirable, if not essential, to provide an enriched mixture for starting and cold running of internal combustion engines. Such an enriched mixture is necessary not only to insure good starting but to insure stable operation at idle and during running when the engine is cold. Two basic type of cold starting and cold running enrichment devices have been employed. One uses a choke valve in the intake passage having a valve element that is moved between a closed and opened position in response to temperature variations to provide the enrichment. The choke valve may be controlled either by an electrically operated system or by means of a bimetallic element. However, such devices are not completely satisfactory because it is difficult to accurately match the opening of the choke valve with the actual running temperature of the engine. Furthermore, it is often difficult to provide both the necessary degree of enrichment during cranking and the required fuel/air mixture during cold running. In addition, choke valves have other well known disadvantages.

As another form of cold starting and cold enrichment device, it has been proposed to provide a starting fuel circuit in the charge forming device for the engine. Such cold starting circuits include an enrichment fuel passage and a valve that is disposed in the enrichment fuel passage and which is movable between a closed, normal running condition and an opened, cold enrichment condition. However, the discharge of such systems is dependent upon the intake manifold vacuum or the vacuum at the point of discharge, which can vary widely during running conditions. Furthermore, the amount of vacuum generated by the engine during cranking may not be sufficient to provide the requisite degree of enrichment during cold starting.

It is, therefore, a principal object of this invention to provide an improved starting fuel increasing system for internal combustion engines.

It is another object of this invention to provide an improved and simplified cold starting and cold running enrichment device for internal combustion engines.

It is a yet further object of this invention to provide a cold starting enrichment device for engines that provides the requisite amount of fuel for cold starting and also an appropriate amount of fuel for good cold running performance.

SUMMARY OF THE INVENTION

This invention is adapted to be embodied in a starting fuel system for internal combustion engines that includes a fuel source and cold starting enrichment means for supplying fuel from the fuel source to the engine. The enrichment means includes control means movable between a normal position wherein the cold starting enrichment means does not provide fuel from the fuel source to the engine and a cold enrichment position for supplying fuel from the fuel source to the engine. In accordance with the invention, means are provided that are responsive to movement of the control means from its normal position to its cold enrichment position for supplying a charge of additional fuel from the fuel source to the engine for starting.

BRIEF DESCRIPTION OF THE DRAWING

The single FIGURE of the drawing illustrates schematically an internal combustion engine and, in cross-section, a cold starting and cold running enrichment device constructed in accordance with the invention.

DETAILED DESCRIPTION OF THE PREFERRED EMBODIMENT

The drawing illustrates the invention as applied to an outboard motor, illustrated in part schematically and indicated generally by the reference numeral 11. The outboard motor 11 includes a three cylinder in-line two-cycle engine, indicated generally by the reference numeral 12 that includes a cylinder block 13 having cylinder bores in which pistons 14 are supported for reciprocation. The pistons 14 are connected by means of connecting rods 15 to a crankshaft 16 that is rotatably journaled within a crankcase 17 of the engine 12 in a known manner.

Because the engine 12 is used in conjunction with an outboard motor, it is disposed so that its crankshaft 16 rotates about a vertically disposed axis. A drive shaft 18, which extends through a drive shaft housing (not shown), is driven from the crankshaft 16 in a known manner. The lower end of the drive shaft 18 drives a forward/neutral/reverse transmission 19 that is adapted to selectively drive a propeller shaft 21 in either a forward or reverse direction. A propeller 22 is fixed to the propeller shaft 21.

The crankcase 17 is divided into three sealed chambers, each respectively associated with a piston 14. A fuel/air charge is delivered to each crankcase chamber by means of a respective carburetor of generally conventional type which is shown schematically and identified generally by the reference numeral 23. Each carburetor 23 includes a throttle valve 24 and a venturi section 25. A suitable fuel discharge circuit or circuits are associated with the carburetors 23 for discharging a fuel/air mixture of appropriate proportions into an intake passage 26 that extends from the throttle valve 24 and which is communicated, by means of a suitable manifold, with the respective crankcase chamber. A reed type check valve 27 is provided in each of the induction passages 26 so as to permit flow to the respective crankcase chambers from the carburetors 23 while at the same time preventing reverse flow. The portion of the construction thus far described may be considered to be conventional and, for that reason, further details of the construction are not believed to be necessary.

The engine 11 is provided with a cold starting and cold enrichment device constructed in accordance with the invention and identified generally by the reference numeral 28. The cold starting and cold running enrichment device 28 includes a fuel source 29 which may be a fuel bowl supplied separately from the fuel system of the engine 12 or which may constitute one of the fuel bowls of one of the carburetors 23.

Fuel is adapted to be delivered from the fuel source 29 to a cold running fuel enrichment port 31 positioned in each of the induction passages 26 downstream of a throttle valve 24 and upstream of the check valve 27 in a manner to be described. The enrichment ports 31 are all fed from a common cold running enrichment passage 32. A control member 33 controls the communication of a cold running enrichment passage 34 which extends from the fuel source 29 with the passage 32 in a manner to be described. A cold running enrichment jet 35 is positioned at the inlet end of the passage 34 for controlling the amount of fuel discharge during cold running enrichment.

The control for the cold running enrichment includes a bore 36 formed in the body of the member that defines the fuel source 29. The bore 36 is intersected by the discharge end of the passage 34 in the inlet end of the passage 32. The control member 33 is formed with a cylindrical valve land 37 that is adapted to close off the communication of the passage 34 with the passage 32 when the control member 33 is in its normal position. Immediately adjacent the land 37, the control member 33 is formed with a relief 38 which, when aligned with the passages 34 and 32, permits communication between them. Above the relief 38, the control member 33 is formed with a cylindrical portion 39 that carries an O-ring seal 41 for sealingly engaging the bore 36.

An air bleed passage 42 communicates with the bore 33 in alignment with the area where the passages 34 and 32 communicate with this bore. When the control member 33 is moved downwardly from the normal position to a cold enrichment position, the relief 38 permits communication between the passages 32 and 34. Air can then flow into this passage through the air bleed 36 to form a fuel/air emulsion that is discharged for cold enrichment through the enrichment ports 31. In addition, this enrichment permits fuel to be drawn during cranking of the engine for cold starting enrichment.

In addition to functioning as a valve to control the cold starting and cold running enrichment, the control member 33 is constructed so as to function as a pumping member so as to inject additional fuel into the induction system to assist in starting. For this purpose, the body in which the fuel source 29 is formed is formed with a counterbore 43 that is aligned with and coaxial with the bore 36. The control member 33 has a cylindrical part 44 that carries an O-ring seal 45 that sealingly engages the counterbore 43 so as to function as a pumping member in the chamber defined counterbore 43.

Fuel may be admitted to the counterbore 43 on the underside of the cylindrical portion 44 through a passage 46 that extends from the fuel source 29. An inlet check valve 47 is positioned in the passage 46 so as to permit fuel to be drawn from the source 29 into the counterbore 43 when the control member 33 moves upwardly and so as to preclude reverse flow when the control member 33 is moved downwardly.

A discharge check valve 48 communicates with the counterbore 43 and is designed so as to permit the discharge of fuel from the counterbore 43 while precluding reverse flow. The check valve 48 serves a starting pump discharge conduit 49 which, in turn, terminates at starting discharge ports 51 formed in each of the carburetors 23 upstream of the throttle valve 24 and venturi section 25.

The FIGURE shows the arrangement as it appears during normal running condition. In this condition and with the engine warmed up, the control member 33 is positioned upwardly so that the land 37 closes off communication between the conduits 32 and 34. At the same time, the upward movement of the cylindrical portion 44 will have drawn fuel from the source 29 through the passage 46 and check valve 47 into the counterbore 43 so as to fill the counterbore 43 with fuel.

When cold starting enrichment is required, the control member 33 is moved downwardly either manually or automatically through any appropriate control device. The downward movement of the control member 33 causes the cylindrical member 44 to compress the fuel in the counterbore 43 and to drive it outwardly past the check valve 48 into the conduit 49 for discharge through the cold starting enrichment ports 51. Hence, an additional fuel will be supplied to the induction passages 26 even before the engine 12 is cranked or turned. This additional fuel will insure good starting of the engine.

When the control member 33 is moved downwardly, the recess 38 will permit the conduits 32 and 34 to communicate with each other thus opening the communication of the source 29 with the cold starting and cold running enrichment ports 31. Hence, during both cranking of the engine and cold speed running, additional enrichment fuel will be delivered through the ports 31 to insure stable running during warm up.

Once the engine is appropriately warmed up, the control member 33 can be moved upwardly either manually or automatically to close off communication between the passages 32 and 34 and to refill the counterbore 43 with starting fuel.

It should be readily apparent that the disclosed construction provides enrichment for cold starting and cold running as well as an additional charge of fuel prior to starting operations so as to improve cold starting. This additional enrichment is achieved through a relatively simple arrangement that is interrelated with the cold enrichment valve and this is simple and foolproof in operation and can be low in cost.

Although an embodiment of the invention has been shown and described, it should be readily apparent that various and modifications can be made without departing from the spirit and scope of the invention, as defined by the appended claims.

I claim:

1. In a starting fuel system for an internal combustion engine comprising a fuel source and cold starting enrichment means for supplying fuel from said fuel source to said engine including control means movable between a normal position wherein said cold starting enrichment means does not provide fuel from said fuel source to the engine and a cold enrichment position for supplying fuel from said fuel source to the engine, the improvement comprising means coupled mechanically to said control means so as to be responsive to movement of said control means from its normal position to its cold enrichment position for supplying a charge of additional fuel from said fuel source to the engine for starting simultaneous with movement of said control means from its normal position to its cold enrichment position.

2. In a starting fuel system for an internal combustion engine comprising a fuel source and cold starting enrichment means for supplying fuel from said fuel source to said engine including control means movable between a normal position wherein said cold starting enrichment means does not provide fuel from said fuel source to the engine and a cold enrichment position for supplying fuel from said fuel source to the engine, the improvement comprising means responsive to movement of said control means from its normal position to its cold enrichment position for supplying a charge of additional fuel from said fuel source to the engine for starting, said charge of additional fuel being delivered to the engine through a different discharge than the discharge of said cold starting enrichment means.

3. In a starting fuel system as set forth in claim 2 wherein the additional fuel is discharged at a different location in the induction system than the cold starting enrichment means discharge.

4. In a starting fuel system as set forth in claim 3 wherein the engine induction system includes a throttle valve and one of the cold enrichment discharges is positioned downstream of the throttle valve and the other is disposed upstream of the throttle valve.

5. In a starting fuel system as set forth in claim 4 wherein the additional fuel discharge is disposed upstream of the throttle valve.

6. In a starting fuel system as set forth in claim 1 wherein the control means comprises a valve.

7. In a starting fuel system as set forth in claim 6 wherein the means responsive to the movement of the valve comprises a pump operatively connected with the valve.

8. In a starting fuel system as set forth in claim 7 wherein the pump comprises a piston pump and the piston is associated with the valve.

9. In a starting fuel system as set forth in claim 8 wherein the valve includes a valve spool and the pump piston is integral with the valve spool.

10. In a starting fuel system as set forth in claim 9 wherein the valve spool cooperates with a bore through which the cold enrichment fuel is delivered and the piston cooperates with a counterbore aligned with the bore in which the valve spool is positioned.

11. In a starting fuel system as set forth in claim 10 wherein the charge of additional fuel is delivered to the engine through a different discharge than the discharge of the cold starting enrichment means.

12. In a starting fuel system as set forth in claim 11 wherein the additional fuel is discharged at a different location in the induction system than the cold starting enrichment means discharge.

13. In a starting fuel system as set forth in claim 12 wherein the engine induction system includes a throttle valve and one of the cold enrichment discharges is positioned downstream of the throttle valve and the other is disposed upstream of the throttle valve.

14. In a starting fuel system as set forth in claim 13 wherein the additional fuel discharge is disposed upstream of the throttle valve.

15. In a starting fuel system as set forth in claim 14 further including means for introducing air to the cold starting enrichment means so as to provide a fuel/air emulsion for cold starting.

* * * * *